US011525653B1

(12) United States Patent
Nance et al.

(10) Patent No.: US 11,525,653 B1
(45) Date of Patent: Dec. 13, 2022

(54) HERMETICALLY SEALED INITIATOR HAVING EXPLODING FOIL INITIATOR MOUNTED TO ALUMINUM END PLATE

(71) Applicant: Reynolds Systems, Inc., Middletown, CA (US)

(72) Inventors: Nicholas C. Nance, Middletown, CA (US); Jacob D. Nance, Middletown, CA (US)

(73) Assignee: Reynolds Systems, Inc., Middletown, CA (US)

( * ) Notice: Subject to any disclaimer, the term of this patent is extended or adjusted under 35 U.S.C. 154(b) by 48 days.

(21) Appl. No.: 17/011,358

(22) Filed: Sep. 3, 2020

Related U.S. Application Data

(60) Provisional application No. 62/896,298, filed on Sep. 5, 2019.

(51) Int. Cl.
*F42B 3/12* (2006.01)

(52) U.S. Cl.
CPC ..... *F42B 3/125* (2013.01); *F42B 3/124* (2013.01)

(58) Field of Classification Search
CPC .. F42B 3/12; F42B 3/103; F42B 3/124; F42B 3/125
USPC ..... 102/202.7, 275.11
See application file for complete search history.

(56) References Cited

U.S. PATENT DOCUMENTS

| | | | | |
|---|---|---|---|---|
| 5,969,286 | A * | 10/1999 | Ward | F42B 3/124 102/202.14 |
| 7,571,679 | B2 | 8/2009 | Nance | |
| 8,408,131 | B1 * | 4/2013 | Nance | F42B 3/12 102/202.14 |
| 8,485,097 | B1 * | 7/2013 | Nance | F42B 3/18 102/202.7 |
| 8,726,808 | B1 * | 5/2014 | Nance | F42B 3/185 102/202.7 |
| 10,345,084 | B1 | 7/2019 | Nance et al. | |
| 10,557,692 | B1 | 2/2020 | Amendola et al. | |
| 10,605,576 | B1 | 3/2020 | Nance et al. | |
| 11,009,319 | B1 * | 5/2021 | Morales | F42B 3/13 |

OTHER PUBLICATIONS

U.S. Appl. No. 16/266,124, filed Feb. 4, 2019; Rule 312 Amendment filed Aug. 24, 2020 (Nicholas C. Nance et al.).

* cited by examiner

*Primary Examiner* — Samir Abdosh
(74) *Attorney, Agent, or Firm* — Burris Law, PLLC

(57) ABSTRACT

An initiator assembly that includes an end plate, a plurality of terminals, a plurality of epoxy plugs, an insulator layer and an exploding foil initiator. The end plate is formed of aluminum and has a plurality of first terminal apertures formed there through. Each of the terminals is received through a corresponding one of the first terminal aperture. Each epoxy plug is received in an associated one of the first terminal apertures and is sealingly engaged to the end plate and to an associated one of the terminals. The insulator layer is received over the end plate. The exploding foil initiator is abutted against the insulator layer and has a bridge and a pair of initiator contacts. Each of the initiator contacts is electrically coupled to a corresponding one of the terminals.

18 Claims, 4 Drawing Sheets

HERMETICALLY SEALED INITIATOR HAVING EXPLODING FOIL INITIATOR MOUNTED TO ALUMINUM END PLATE

CROSS-REFERENCE TO RELATED APPLICATIONS

This application claims the benefit of U.S. Provisional Application No. 62/896,298 filed Sep. 5, 2019, the disclosure of which is incorporated by reference as if fully set forth in detail herein.

FIELD

The present disclosure relates to a hermetically sealed initiator having an exploding foil initiator that is mounted to an aluminum end plate.

BACKGROUND

This section provides background information related to the present disclosure which is not necessarily prior art.

Modern initiators, such as detonators, commonly employ materials including ceramics and stainless steels in their construction. These materials are typically selected to provide the initiator with a degree of robustness that permits the initiator to withstand extreme changes in temperature and humidity, as well as to resist oxidization. While modern initiator configurations are generally satisfactory for their intended purposes, they are nonetheless susceptible to improvement.

For example, many of these initiators, particularly those that employ exploding foil initiators, are relatively difficult and labor-intensive to fabricate. Consequently, they are relatively expensive and are not employed in many applications due to considerations for cost. One solution is a plastic encapsulated energetic material initiation device of the type that is disclosed in U.S. Pat. No. 7,690,303, the disclosure of which is hereby incorporated by reference as if fully set forth in detail herein. This energetic material initiation device, however, may not be suited for some applications, such as in devices that experience relatively high shock loads and/or require a very strong and durable hermetic seal.

Another solution is an energetic material initiation device of the type that is disclosed in U.S. Pat. No. 7,571,679, the disclosure of which is incorporated by reference as if fully set forth in detail herein. The energetic material initiation device has a header with borosilicate glass seals that are disposed between the header and terminals that penetrate through the header. While this energetic material initiation device is capable of operating after experiencing relatively high shock loads and provides a relatively strong and durable hermetic seal, it is not suited for applications where the energetic material initiation device has a housing that is formed of aluminum (because the borosilicate glass melts at a temperature that is above the melting point of aluminum).

SUMMARY

This section provides a general summary of the disclosure, and is not a comprehensive disclosure of its full scope or all of its features.

In one form, the present teachings provide an initiator assembly that includes an end plate, a plurality of terminals, a plurality of epoxy plugs, an insulator layer and an exploding foil initiator. The end plate is formed of aluminum and has a plurality of first terminal apertures formed there through. Each of the terminals is received through a corresponding one of the first terminal aperture. Each epoxy plug is received in an associated one of the first terminal apertures and is sealingly engaged to the end plate and to an associated one of the terminals. The insulator layer is received over the end plate. The exploding foil initiator is abutted against the insulator layer and has a bridge and a pair of initiator contacts. Each of the initiator contacts is electrically coupled to a corresponding one of the terminals.

In another form, the present teachings provide an initiator assembly that includes an end plate, a plurality of terminals, a plurality of epoxy plugs, an insulator layer, a frame member, an exploding foil initiator and a plurality of terminal-to-initiator contacts. The end plate formed of aluminum and has a plurality of first terminal apertures formed there through. Each of the terminals being received through a corresponding one of the first terminal apertures. Each epoxy plug is received in an associated one of the first terminal apertures and is sealingly engaged to both the end plate and to an associated one of the terminals. The insulator layer is received over the end plate. The frame member overlies the insulating spacer and defines an interior aperture into which the exploding foil initiator is received. The exploding foil initiator has a bridge and a plurality of initiator contacts and is abutted against the insulator layer. Each of the terminal-to-initiator contacts is electrically coupled to a corresponding one of the terminals and a corresponding one of the initiator contacts.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
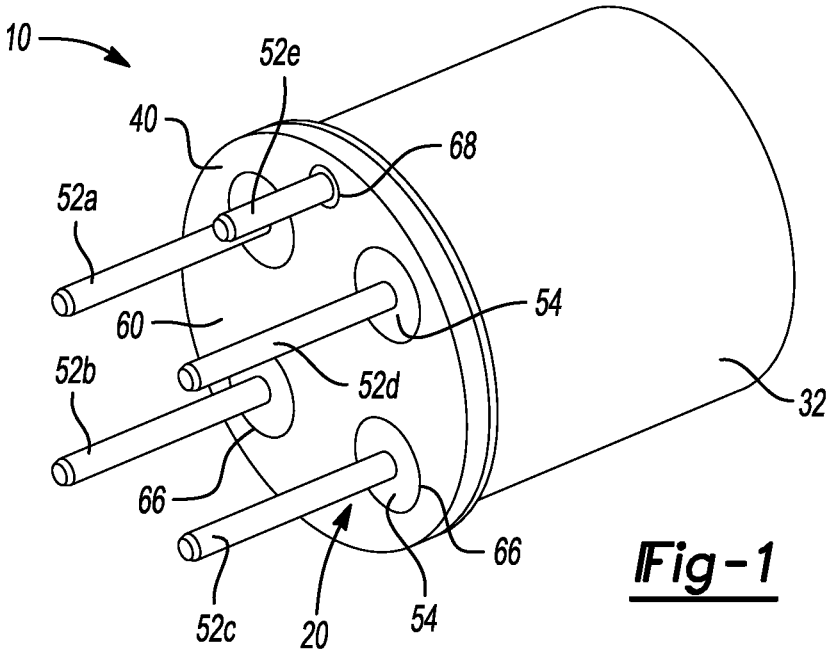
FIG. 1 is a rear perspective view of an exemplary initiator assembly constructed in accordance with the teachings of the present disclosure.
Figure 2:
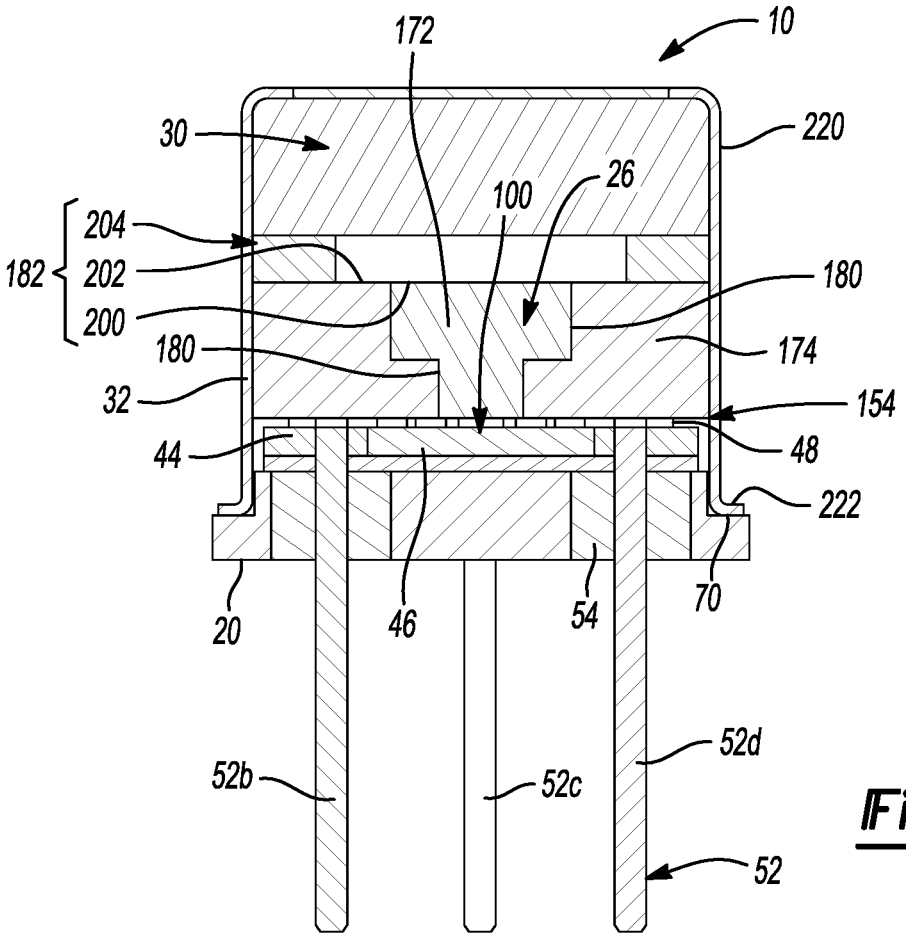
FIG. 2 is a longitudinal section view of the initiator assembly of FIG. 1.

With reference to FIGS. 1 and 2 of the drawings, an initiator constructed in accordance with the teachings of the present invention is generally indicated by reference numeral 10. While the initiator 10 is illustrated as being a detonator-type initiator, the initiator 10 may be any type of initiator and may be configured to initiate a combustion event, a deflagration event and/or a detonation event. The initiator 10 can include a housing member assembly 20, an input charge assembly 26, an output charge 30 and a cover 32.

Figure 3:
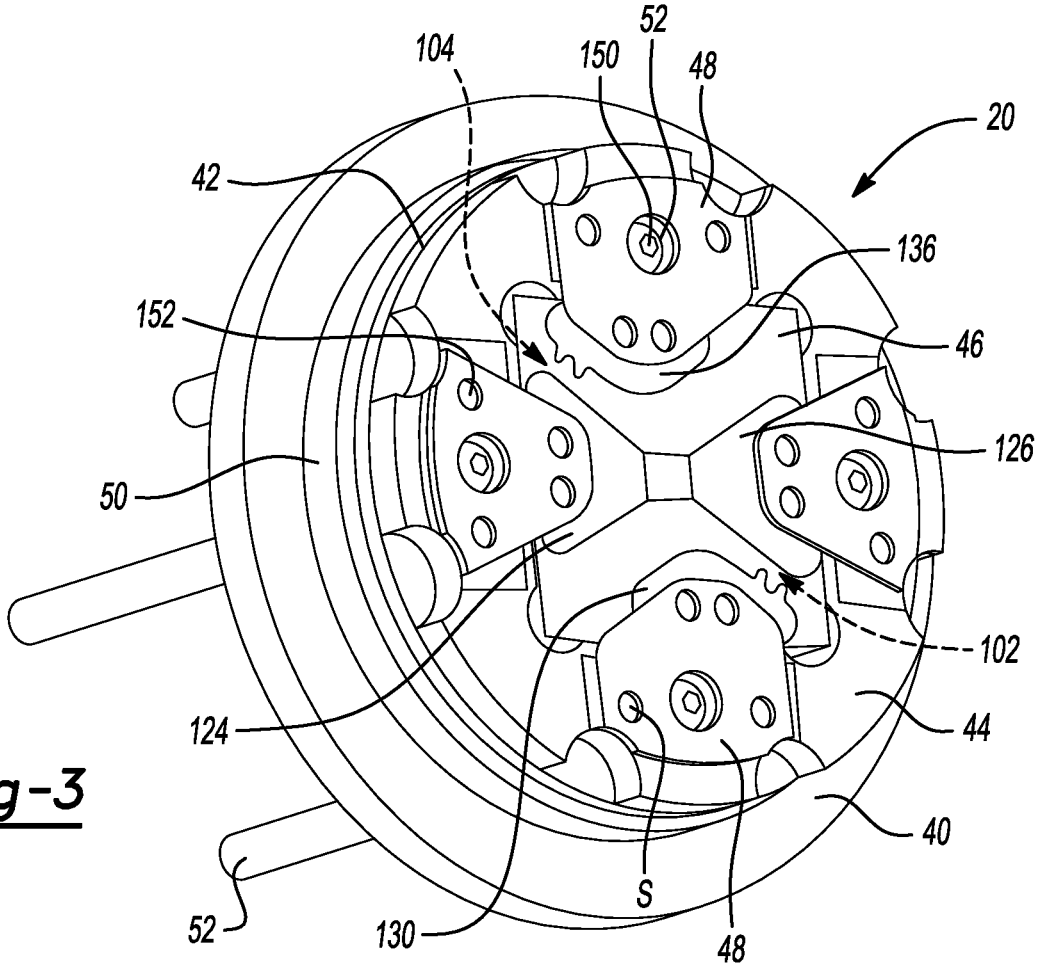
FIG. 3 is a front perspective view of a portion of the initiator assembly of FIG. 1, illustrating the housing member assembly in more detail.
Figure 4:
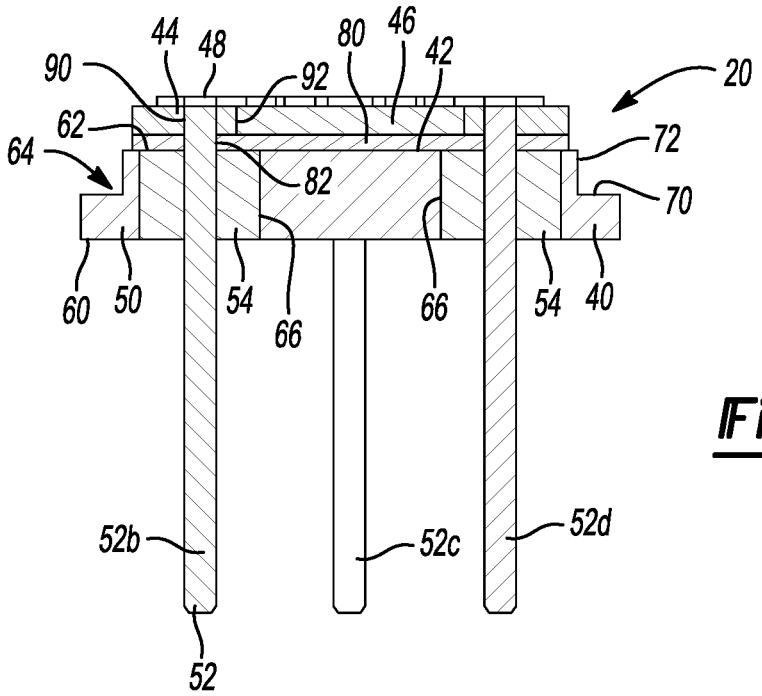
FIG. 4 is a longitudinal section view of the housing member assembly.

With reference to FIGS. 3 and 4, the housing member assembly 20 can include an end plate assembly 40, an insulator layer 42, an optional frame member 44, an initiator chip 46 and a plurality of contacts 48. The end plate assembly 40 can include an end plate 50, a plurality of terminals 52, and a plurality of plugs 54.

The end plate 50 is formed of aluminum but can be formed of another material if desired. The end plate 50 can define first and second end faces 60 and 62, respectively, a shoulder 64, a plurality of first terminal apertures 66 and a second terminal aperture 68 (FIG. 1). The shoulder 64 can include an abutting face 70, which can be generally parallel to the first and second end faces 60 and 62, and a shoulder wall 72 that is generally perpendicular to the abutting face 70. The first terminal apertures 66 can be formed through the end plate 50 generally perpendicular to the first and second end faces 60 and 62. The second terminal aperture 68 (FIG. 1) can be a blind hole that is formed in the end plate 50 through the first end face 60.

Figure 5:
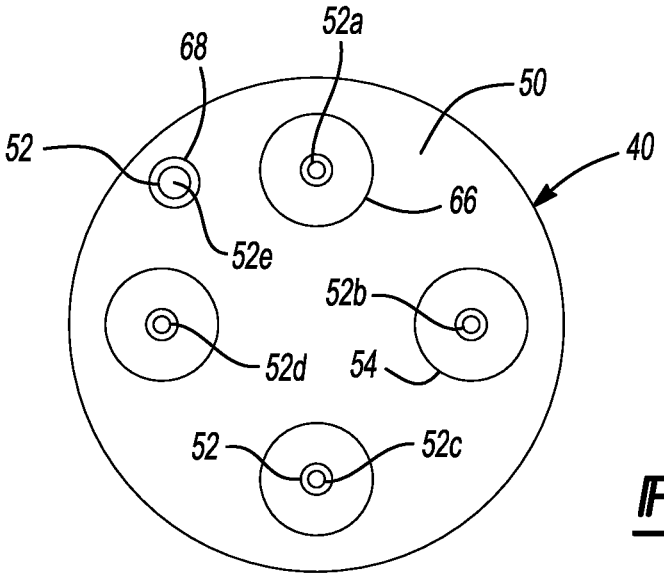
FIG. 5 is a bottom view of the housing member assembly.

With reference to FIGS. 4 and 5, a first quantity of the terminals 52 (i.e., terminals 52*a* through 52*d* in the example provided) can be received in respective ones of the first terminal apertures 66 and can extend outwardly from the first and second end faces 60 and 62. A remaining one of the terminals 52 (i.e., terminal 52*e* in the example provided) can be received in the second terminal aperture 68 and can be fixedly electrically coupled to the end plate 50. In the particular example provided, the terminal 52*e* is soldered to the end plate 50 and serves as a means for electrically coupling the end plate 50 to an electric ground (not shown). It will be appreciated that the terminals 52 can be arranged in a non-symmetrical manner to thereby key the end plate assembly 40 in a particular orientation relative to the device (not shown) to which the initiator 10 (FIG. 1) is to be coupled. It will also be appreciated that a keying feature, such as a tab (not shown) or a recess (not shown), can be incorporated into a portion of the end plate assembly 40 (e.g., the end plate 50) to key the end plate assembly 40 in a particular orientation.

The plugs 54 can be formed of a suitable material, such as an epoxy sealant. In the particular example provided, the plugs 54 are formed of an Epoxy DC-204 material that is commercially available from Multi-Seals, Incorporated of Manchester, Conn. Each of the plugs 54 can be received into an associated one of the first terminal apertures 66 and can sealingly engage the end plate 50 as well as an associated one of the terminals 52. The plugs 54 can form a relatively strong seal, such as a seal that will leak at a rate less than about $1\times10^{-5}$ or $1\times10^{-6}$ units when one side of the end plate 50 is exposed to helium gas at a gauge pressure of about 1 atmosphere while the other side of the end plate 50 is exposed to atmospheric pressure.

In FIG. 4, the insulator layer 42 can be formed of a suitable dielectric material, such as polycarbonate, synthetic resin bonded paper (SRBP) or epoxy resin bonded glass fabric (ERBGF), and can define a body 80 having a plurality of clearance apertures 82 that are sized to receive the terminals 52*a* through 52*d* (FIG. 1) there through. The body 80 can be received onto the second end face 62 and within a volume that is defined by the shoulder wall 72.

Figure 6:
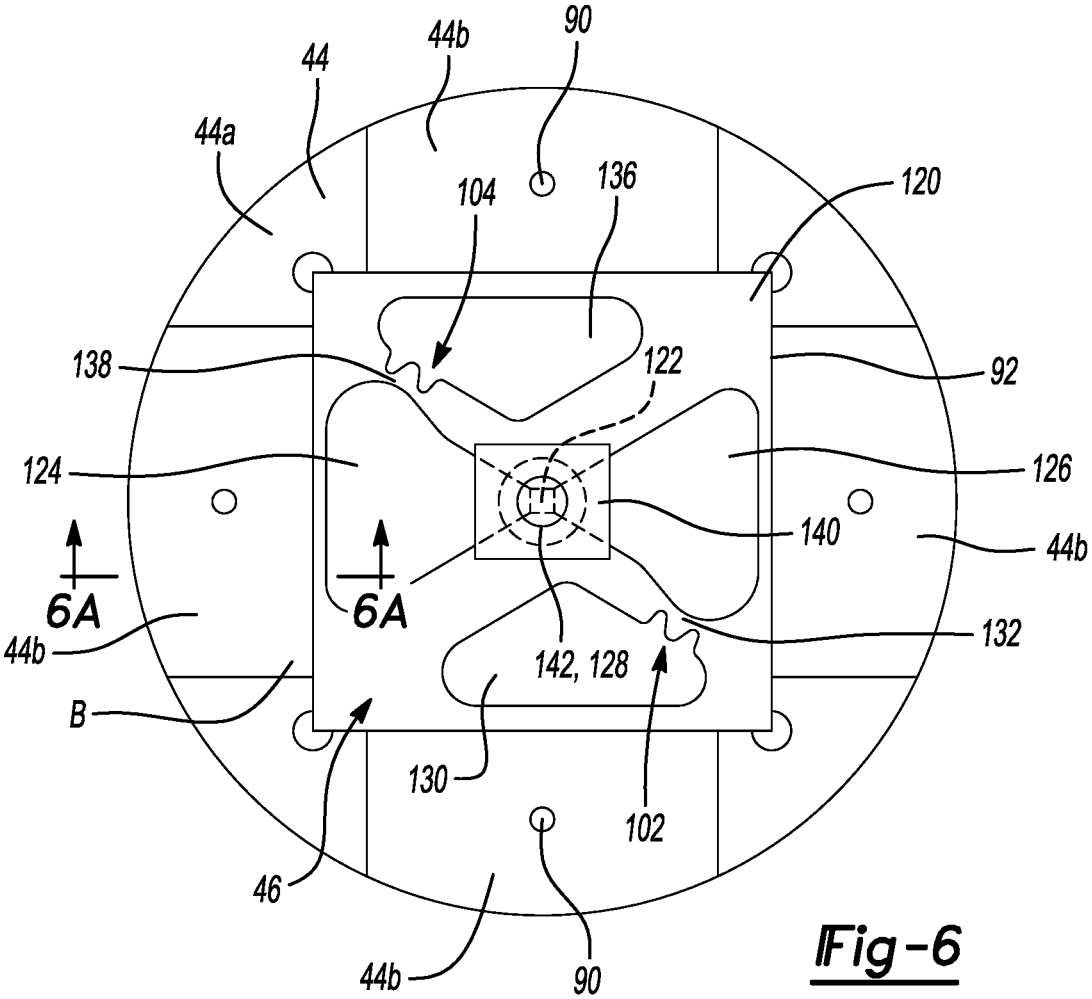
FIG. 6 is a top plan view of a portion of the housing member assembly illustrating the frame member and the initiator chip in more detail.

With reference to FIGS. 3, 4 and 6, the frame member 44 can include a body 44*a* and a plurality of electrical conductors 44*b*. The body 44*a* can be formed of an appropriate dielectric material, such as synthetic resin bonded paper (SRBP) or epoxy resin bonded glass fabric (ERBGF). The electrical conductors 44*b* can be arranged about the body 44*a* in a predetermined manner and can comprise one or more conductive layers of material, such as gold, silver, copper, nickel, and alloys thereof. The electrical conductors 44*b* can be formed onto the body 44*a* in any desired manner, such as through metallization of the entire surface of the body 44*a* and acid-etch removal of portions of the metallization that are not desired. The frame member 44 can be sized and shaped to closely conform to the size and shape of the insulator layer 42 and can include a plurality of terminal apertures 90 and an interior aperture 92 that is sized to receive the initiator chip 46. The terminal apertures 90 can be sized to receive a corresponding one of the terminals 52 (e.g., terminals 52*a* through 52*d* in FIG. 5) therein.

With reference to FIG. 6, the initiator chip 46 of the particular example illustrated is constructed in a manner that is disclosed in commonly assigned U.S. Pat. Nos. 7,552,680 and 7,543,532 entitled "Full Function Initiator With Integrated Planar Switch" the disclosures of which are hereby incorporated by reference as if fully set forth in detail herein. Briefly, the initiator chip 46 includes at least a portion of an exploding foil initiator 100 (FIG. 2), a first switch 102 and a second switch 104.

The at least a portion of the exploding foil initiator 100 (FIG. 2) can conventionally include a substrate 120, a bridge 122, first and second bridge contacts 124 and 126, respectively, and a flyer 128. The substrate 120 can be formed of an appropriate structural material, such as a ceramic. The bridge 122 and the first and second bridge contacts 124 and 126 can be coupled to the substrate 120 and can be formed of an appropriate conductive material, such as one or more layers of gold, silver, copper, nickel and alloys of one or more thereof. The bridge 122 and the first and second bridge contacts 124 and 126 can be formed in one or more layers that can be deposited onto the substrate 120 in an appropriate manner, such as by vapor deposition. The first switch 102 can include a first switch pad 130 that can be coupled to the substrate 120 and offset from the second bridge contact 126 by a first gap 132. The second switch 104 can include a second switch pad 136 that can be coupled to the substrate and offset from the first bridge contact 124 by a second gap 138. While the initiator chip 46 has been illustrated and described as including at least a portion of an exploding foil initiator and one or more switches that provide the initiator chip 46 with integrated switching capabilities, those of ordinary skill in the art will appreciate that any appropriate initiator chip may be employed, such as an initiator chip that does not have or include integrated switching capabilities. The flyer 128 can be formed of an appropriate material, such as polyamide. Optionally, a barrel 140 can be coupled to the substrate 120 and can overlie the bridge 122 and the flyer 128. The barrel 140 can define a barrel aperture 142 through which the flyer 128 can be expelled when the exploding foil initiator (FIG. 2) is operated and the bridge 122 is vaporized.

Figure 6A:
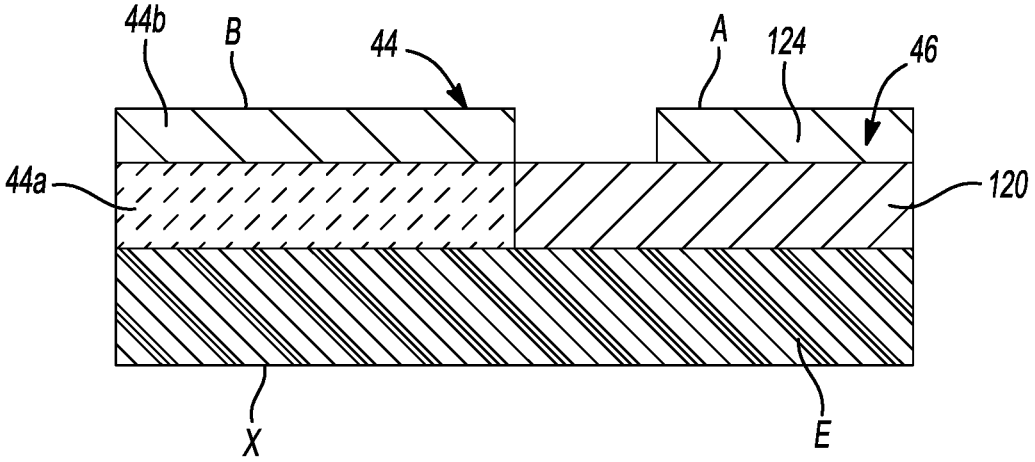
FIG. 6A is a section view taken along the line 6A-6A of FIG. 6.

With additional reference to FIGS. 4 and 6, the initiator chip 46 can be received in the interior aperture 92 that is formed by the frame member 44. In the particular example provided, an adhesive, such as SCOTCH-WELD™ EC-2216 Grey epoxy marketed by Minnesota Mining and Manufacturing Company of St. Paul, Minn., is employed to bond the frame member 44 and the initiator chip 46 to the insulator layer 42 as well as to bond the insulator layer 42 to the end plate 50. It will be appreciated that the surface A (FIG. 6A) of the initiator chip 46 and the surface B (FIG. 6A) of the frame member 44 can be abutted against a flat surface (not shown) while the adhesive cures so that the surfaces A and B will be substantially parallel and co-planar. With reference to FIG. 6A, the epoxy E can be applied to the surfaces of the initiator chip 46 and the frame member 44 opposite the surfaces A and B, respectively. The epoxy E can be employed to secure the frame member 44 and the initiator chip 46 to one another, as well as to provide a bottom surface X of the assembly that is generally parallel to the surfaces A and B. In this way, the top and bottom surfaces of the assembly (i.e., the frame member 44, the initiator chip 46 and the epoxy E) can be flat and parallel within a desired tolerance, such as 0.001 inch. The terminal apertures 90 in the frame member 44 can be formed via a suitable process, such as drilling.

With reference to FIG. 3, the contacts 48 can be formed of a suitable electrically conductive material, such as KOVAR® having a thickness of about 0.003 inch, and can include a terminal aperture 150 that can receive an associated one of the terminals 52 (e.g., the terminals 52*a* through 52*d* in FIG. 5) and a plurality of solder apertures 152. The contacts 48 can be shaped to engage an associated electric interface (e.g., the first bridge contact 124, the second bridge contact 126, the first switch pad 130, the second switch pad 136). In the particular example provided, the contacts 48 are soldered to an associated one of the terminals 52 and an associated one of the electric interfaces with an appropriate solder S, such as a F540SN62-86D4 solder paste marketed by Heraeus Inc., Circuit Materials Division of Scottsville, Ariz. The solder apertures 152 permit solder to flow through the contacts 48 in predetermined areas, such as locations in-line with the associated electric interfaces and in-line with the electrical conductors 44*b* (FIG. 6) of the frame member 44. Accordingly, it is possible to visually-inspect the solder joints associated with each contact 48 through the solder apertures 152 and the terminal aperture 150.

Figure 7:
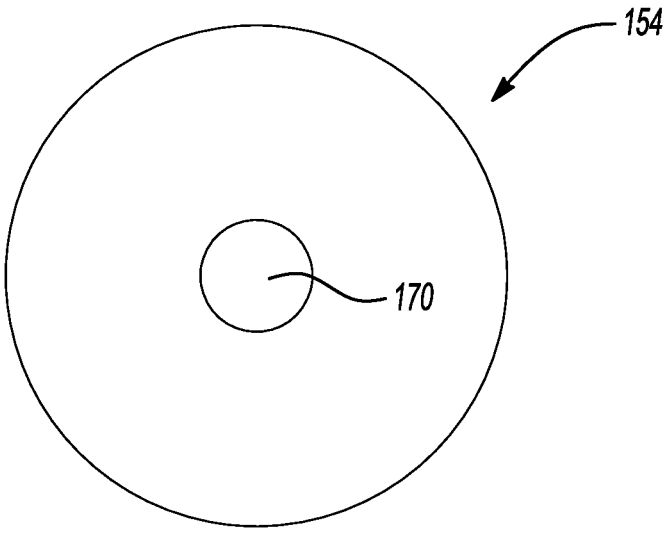
FIG. 7 is a top plan view of a portion of the initiator assembly illustrating an optional insulator barrel.

With reference to FIGS. 2 and 7, an insulator barrel 154 can optionally be disposed between the initiator chip 46 and the input charge assembly 26. The insulator barrel 154 can be formed of one or more layers of suitable materials and can be configured to electrically insulate and/or physically separate portions of the housing member assembly 20 from the input charge assembly 26. In the example provided, the insulator barrel 154 is formed from a suitable electrically insulating material, such as polyamide, but it will be appreciated that the insulator barrel 154 could comprise one or more additional layers that can be formed of a suitable material, such as polytetrafluoroethylene or a metal such as titanium or aluminum. The insulator barrel 154 can cover the frame member 44 and the contacts 48 to electrically isolate these elements from the input charge assembly 26. Optionally, the insulator barrel 154 can define a barrel aperture 170 through which the flyer 128 (FIG. 6) may be expelled when the initiator chip 46 is activated. In this regard, it will be appreciated that the barrel aperture 170, the flyer 128 (FIG. 6) and the bridge 122 (FIG. 6) are disposed in-line with one another.

It will be appreciated that the thicknesses of the insulator barrel 154, the contacts 48 and the solder that couples the contacts 48 to the terminals 52 and the electric interfaces is selected to space the bridge 122 (FIG. 6) apart from the input charge assembly 26 by a predetermined spacing, such as about 0.004 inch to about 0.008 inch. It will be also appreciated that it can be important in some situations that the contacts 48 be relatively flat so as not to affect the spacing between the bridge 122 (FIG. 6) and the input charge assembly 26.

In FIG. 2, the input charge assembly 26 can include an input charge 172 and an optional input sleeve 174. The input charge 172 can be formed of a suitable energetic material, such as a high explosive material. In the example provided, the input charge 172 is formed of a secondary explosive material, such as RSI-007, which is available from Reynolds Systems, Inc. of Middletown, Calif. The input sleeve 174 can be configured to support the input charge 172 and direct energy from the input charge 172 in a desired direction. In the particular example provided, the input sleeve 174 is formed of a suitable steel and defines a cavity 180 that can be located in-line with the bridge 122 (FIG. 6). The input charge 172 can be received in the cavity 180 in the input sleeve 174 and compacted to a desired density. It will be appreciated that in some applications, the input charge 172 may fill the entire volume of the cavity 180. It will also be appreciated that in some applications the input sleeve 174 may be omitted.

An optional barrier 182 can be employed to separate the input charge assembly 26 from the output charge 30. In the particular example provided, the barrier 182 includes a first barrier member 200, a second barrier member 202 and a resilient member 204. The first barrier member 200, which can be abutted against the input sleeve 174, can be a formed of a reactive material, which may be a metal, such as titanium, or another suitably reactive material that is inert under normal circumstances. The second barrier member 202, which can be abutted against the first barrier member 200, can be formed of an oxidizable material, such as polytetrafluoroethylene. The resilient member 204 can be an annular silicone rubber element and can be disposed between the second barrier member 202 and the output charge 30. The barrier 182 can be tailored to a desired application to permit a desired amount of energy to be transmitted to the output charge 30 in a desired amount of time. In the particular example provided, the barrier 182 is employed to somewhat attenuate the energy that is released by the input charge assembly 26, as well as to employ a portion of the energy that is released from the input charge assembly 26 to initiate a reaction between the first and second barrier members 200 and 202 that generates additional heat.

The output charge 30 can be formed of a suitable energetic material, such as a high explosive material. In the example provided, the output secondary explosive and can be abutted against a side of the barrier 182 opposite the input sleeve 174. In the particular example provided, the output charge 30 is abutted against a side of the resilient member 204 opposite the second barrier member 202.

The cover 32 can be formed of a suitable material, such as aluminum, and can include a cover body 220 and a rim 222. The cover body 220 can be a cup-line structure that can receive the portion of the initiator 10 outwardly of the abutting face 70. The rim 222 can extend radially outwardly from the cover body 220 and can matingly engage the abutting face 70. The rim 222 and the shoulder 64 (FIG. 4) can be welded in an appropriate manner (e.g., laser welded) to fixedly and sealingly couple the cover 32 to the end plate 50. It will be appreciated that a preload force can be applied to the cover 32 to seat the cover 32 to the end plate 50 and as such, various components of the initiator 10, such as the output charge 30, the barrier 182, the frame member 44 and the initiator chip 46 can be maintained in a state of compression.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An initiator assembly comprising:

an end plate formed of aluminum and having a plurality of first terminal apertures formed there through;

a plurality of terminals, each of the terminals being received through a corresponding one of the first terminal apertures;

a plurality of epoxy plugs, each epoxy plug being received in an associated one of the first terminal apertures and sealingly engaged to the end plate and to an associated one of the terminals;

an insulator layer received over the end plate; and an exploding foil initiator having a bridge and a pair of initiator contacts, the exploding foil initiator being abutted against the insulator layer, each of the initiator contacts being electrically coupled to a corresponding one of the terminals.

2. The initiator assembly of claim 1, wherein a terminal-to-initiator contact forms at least a portion of an electrical path that electrically couples each of the initiator contacts with the corresponding one of the terminals.

3. The initiator assembly of claim 1, further comprising a cover welded to the end plate, the cover and the end plate cooperating to form a housing assembly having at least one hermetically sealed interior cavity.

4. The initiator assembly of claim 3, wherein the end plate comprises a shoulder that defines a face that is perpendicular to longitudinal axes of the terminals, wherein the cover has a rim that abuts the face and wherein the rim is welded to the shoulder to fixedly and sealingly couple the cover to the end plate.

5. The initiator assembly of claim 3, further comprising an output charge disposed in the at least one hermetically sealed cavity, the output charge being formed of an energetic material.

6. The initiator assembly of claim 5, wherein the energetic material is a high explosive.

7. The initiator assembly of claim 6, wherein the high explosive is a secondary explosive.

8. The initiator assembly of claim 1, wherein the exploding foil initiator comprises an input charge formed of a high explosive material.

9. The initiator assembly of claim 8, wherein the high explosive material is a secondary explosive.

10. The initiator assembly of claim 1, further comprising a frame member overlying the insulator layer, the frame member defining an interior aperture into which the exploding foil initiator is received.

11. An initiator assembly comprising:

an end plate formed of aluminum and having a plurality of first terminal apertures formed there through;

a plurality of terminals, each of the terminals being received through a corresponding one of the first terminal apertures;

a plurality of epoxy plugs, each epoxy plug being received in an associated one of the first terminal apertures and sealingly engaged to the end plate and to an associated one of the terminals;

an insulator layer received over the end plate;

a frame member overlying the insulator layer, the frame member defining an interior aperture;

an exploding foil initiator having a bridge and a plurality of initiator contacts, the exploding foil initiator being received into the interior aperture in the frame member and being abutted against the insulator layer; and a plurality of terminal-to-initiator contacts, each of the terminal-to-initiator contacts being electrically coupled to a corresponding one of the terminals and a corresponding one of the initiator contacts.

12. The initiator assembly of claim 11, further comprising a cover welded to the end plate, the cover and the end plate cooperating to form a housing assembly having at least one hermetically sealed interior cavity.

13. The initiator assembly of claim 12, wherein the end plate comprises a shoulder that defines a face that is perpendicular to longitudinal axes of the terminals, wherein the cover has a rim that abuts the face and wherein the rim is welded to the shoulder to fixedly and sealingly couple the cover to the end plate.

14. The initiator assembly of claim 12, further comprising an output charge disposed in the at least one hermetically sealed cavity, the output charge being formed of an energetic material.

15. The initiator assembly of claim 14, wherein the energetic material is a high explosive.

16. The initiator assembly of claim 15, wherein the high explosive is a secondary explosive.

17. The initiator assembly of claim 11, wherein the exploding foil initiator comprises an input charge formed of a high explosive material.

18. The initiator assembly of claim 17, wherein the high explosive material is a secondary explosive.

* * * * *